US006776469B2

(12) United States Patent
Nozawa

(10) Patent No.: US 6,776,469 B2
(45) Date of Patent: Aug. 17, 2004

(54) INK JET PRINTING APPARATUS AND PRINTING HEAD

(75) Inventor: Minoru Nozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/254,790

(22) Filed: Sep. 26, 2002

(65) Prior Publication Data

US 2003/0030685 A1 Feb. 13, 2003

Related U.S. Application Data

(62) Division of application No. 09/619,487, filed on Jul. 19, 2000, now Pat. No. 6,499,821.

(30) Foreign Application Priority Data

Jul. 22, 1999 (JP) ..... 11-207996

(51) Int. Cl.[7] ..... B41J 29/38; B41J 29/393
(52) U.S. Cl. ..... 347/14; 347/19; 347/11
(58) Field of Search ..... 347/43, 14, 19

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,723,129 | A | 2/1988 | Endo et al. |
| 4,740,796 | A | 4/1988 | Endo et al. |
| 4,812,859 | A | 3/1989 | Chan et al. |
| 5,581,281 | A | 12/1996 | Fuse |
| 5,877,785 | A | 3/1999 | Iwasaki et al. |
| 6,053,595 | A | 4/2000 | Otsuka et al. |

FOREIGN PATENT DOCUMENTS

| | | |
|---|---|---|
| EP | 0 709 197 | 5/1996 |
| EP | 0 838 332 | 4/1998 |
| JP | 54-56847 | 5/1979 |
| JP | 60-71260 | 4/1985 |
| JP | 4-133743 | 5/1992 |
| JP | 7-256895 | 10/1995 |

*Primary Examiner*—Thinh Nguyen
(74) *Attorney, Agent, or Firm*—Fitzpatrick, Cella, Harper & Scinto

(57) ABSTRACT

A printing apparatus includes a unit which counts the number of drive pulses applied to a print head and accumulatively stores the number of the drive pulses from the start of initial use of the printing head, and a unit which measures a temperature of the printing head and a time elapsed at the temperature in conjunction with each other, and stores a temperature history. The printing apparatus controls a timing of ink ejection from the printing head and an amount of ink to be ejected by adjusting a width of the drive pulses dependently on stored contents (a use history of the printing head) to maintain a stable image quality by adequately preventing ejecting characteristics and dot forming locations on a printing medium from being varied due to a use history of the print head.

17 Claims, 12 Drawing Sheets

INK JET PRINTING APPARATUS AND PRINTING HEAD

This application is a division of application Ser. No. 09/619,487 filed Jul. 19, 2000 now U.S. Pat. No. 6,499,821.

This application is based on Japanese Patent Application No. 11-207996 (1999) filed Jul. 22, 1999, the content of which is incorporated hereinto by reference.

BACKGROUND OF THE INVENTION

1. Field of the Invention

The present invention relates to an ink jet printing apparatus and an ink jet printing head.

2. Description of the Related Art

Recording apparatuses (printing apparatuses) for recording (printing) on recording media such as paper and sheets for OHP (hereinafter referred to as recording paper or simply as paper) are classified into the so-called serial type which uses a recording head mounted on a movable member (hereinafter referred to as a carriage) reciprocally moving in a direction (main scanning direction) perpendicular to a recording paper transporting direction and a line type which uses a recording head having recording elements arranged within a range corresponding to a width of the recording paper. These recording apparatuses use recording heads which are configured for various recording systems such as a wire dot recording system, a thermal recording system, a heat transfer recording system, an ink jet recording system and an electrophotographic recording system.

Furthermore, there are widely used electronic appliances or data processing systems equipped with these recording apparatuses, and apparatuses which are electrically connected to the recording apparatus by way of interfaces and provide commands related to edition and recording of data to be recorded with the recording apparatuses, and which constitute image data supply sources and may be computers as data processing apparatuses, image reading apparatuses or the like.

Out of the recording apparatuses mentioned above, ink jet recording apparatuses mostly comprise ink tanks for supplying ink as a recording agent and recording heads for ejecting supplied ink to the recording paper, and are generally configured to replace the ink tanks with others when the ink is consumed substantially in the ink tanks. In the recent years, there is used a construction using a recording head cartridge wherein an ink tank is integrated fixedly or detachably with a recording head thereby allowing the ink tank to be exchanged together with the recording head or to be detached from a recording head for exchanging, when the ink is consumed substantially in the ink tank.

Furthermore, there have been prevailing recording apparatuses which are capable of performing various printing works (for example, monochromatic and color printing works) while adequately exchanging recording heads or cartridges for different kinds of ink (for example, black ink and color ink) for optimum recording of data matched with kinds of data to be recorded, with compact constructions.

Out of the recording apparatuses which have the above described construction, a certain apparatus is configured to be capable of informing a user of data of a recording agent such as ink consumed as a recording work proceeds: a consumed amount of ink or an amount of ink held in an ink tank (residual amount of ink). Furthermore, a certain recording apparatus carries out the an operation to secure favorable recording condition (so-called ejection recovery operation) before starting a recording operation after recording agent supply means such as an ink tank or a recording head is exchanged.

Since the above-described ink jet recording apparatus is accompanied by a fear that it may wastefully consume the recording paper on which recording is interrupted when the printer can hardly continue a recording operation in the course of recording, it is preferable to stop the recording before the printer can hardly continue the recording operation actually and restart the recording operation after preliminarily obtaining a condition where the recording operation cannot be interrupted. Causes which make it hard to continue the recording operation in the course of recording are traced mostly to small residual amounts of ink. Accordingly, it is preferable to measure a residual amount of ink at times and provide warning when the residual amount is lowered to a predetermined level, thereby urging a user to replenish ink (exchange an ink tank or the like).

On the other hand, remarkable progresses have recently been made in photographic printers which provide images of the so-called photographic quality, and recording heads used for these printers have been configured acceleratedly for higher densities and smaller dots, whereby recording densities are now enhanced to 600 to 1200 DPI (dots/inch) and ink ejecting amounts are now reduced to 8 to 4 pl (picoliters). Such recording heads are apt to produce stripes, color ununiformities, textures and the like perceived by human eye on recorded images due to slight variations of ink ejecting characteristics from ejecting openings. Since the ejecting characteristics are varied and image qualities are degraded as the recording heads are used for a long time, the recording heads have image forming service lives shorter than conventional recording heads even when nozzles themselves including ink jet elements (heating elements of a recording head which use thermal energy for ejecting ink or piezoelectric elements of a recording head which use mechanical energy for ejecting ink) are free from uncorrectable problems.

SUMMARY OF THE INVENTION

The present invention has been achieved in view of points described above and has an object to adequately control variations of ejecting characteristics and dot forming locations on a recording medium (printing medium) due to a use history of a recording head (printing head), thereby making it possible to maintain a stable image quality for a long time.

In a first aspect of the present invention, there is provided an ink jet printing apparatus which carries out printing using a printing head for ejecting ink, comprising:

- means for measuring data related to a use history of the printing head; and
- means for controlling a timing of ink ejection from the printing head on the basis of the data related to the use history.

In a second aspect of the present invention, there is provided a printing method using a printing head for ejecting ink, comprising the steps of:

- measuring data related to a use history of the printing head; and
- controlling a timing of ink ejection from the printing head on the basis of the data related to the use history.

In the first or second aspect, the printing head may have ejection openings arranged in a plurality of columns in a direction different from a relative scanning direction to a printing medium, and the control means or step may control an ink ejection timing between the plurality of columns.

The first or second aspect of the present invention may further comprise means for or step of printing by bi-directionally scanning the printing head relative to a printing medium, and the control means or step may control an ink ejection timing in a forward direction relative to an ink ejection timing in a backward direction.

In the first or second aspect, the control means or step may control an amount of ink to be ejected by adjusting an energy of a drive signal to be applied to the printing head for ejecting the ink.

Here, the control means or step may adjust a width of the drive pulse to be applied to the printing head.

In the first or second aspect, the measuring means or step may have means for or step of counting the number of drive signals applied to the printing head for ejecting the ink.

Here, memory means may be comprised for accumulatively storing the number of the drive signals from the start of the initial use of the printing head as data related to the use history on the basis of measurements by the measuring means.

In the first aspect, the measuring means may have means for measuring a temperature of the printing head and a time elapsed at the temperature in conjunction with each other.

Here, memory means may be comprised for storing a temperature history from an operation start of the printing head as the data related to the use history on the basis of measurements by the measuring means.

In the first aspect, the measuring means may have means for counting the number of drive signals applied to the printing head for ejecting the ink, and means for measuring a temperature of the printing head and a time elapsed at the temperature in conjunction with each other; and the control means, according to the data related to the use history on the basis of measurement by the measuring means, may control the timing of the ink ejection from the printing head and control an amount of the ink to be ejected by adjusting an energy of a drive signal to be applied to the printing head for ejecting the ink.

Here, memory means may be comprised for accumulatively storing the number of the drive signals from the start of the initial use of the printing head and a temperature history, as the data related to the use history on the basis of the measurements by the measuring means.

In a third aspect of the present invention, there is provided a printing head used for an ink jet printing apparatus having means for measuring data related to a use history of the printing head and means for controlling a timing of ink ejection from the printing head on the basis of the data related to the use history, the printing head being a form of a unit detachably mounted on the ink jet printing apparatus, the printing head comprising:

means for ejecting ink; and means for storing data related to the use history on the basis of measurement by the measuring means.

Here, the ejecting means may have an electrothermal transducer for generating thermal energy to make the ink film-boil, as an energy used for ejecting the ink.

Incidentally, in this specification, the term "print" (also referred to as "record") represents not only forming significant information, such as characters, graphic images or the like, but also represents forming images, patterns and the like on the printing medium irrespective of whether it is significant or not and whether the formed images are to be visually perceptible or not, in broad sense, and further includes the case where the medium is processed.

In addition, the term "printing medium" refers to paper for use in general printing apparatuses as well as a medium such as a cloth, a plastic film, and a metallic plate and the like and any substance which can receive inks ejected by the heads in broad sense.

Further, the term "ink" has to be understood in broad sense similarly to the definition of "print" and should include any liquid to be used for formation of image patterns and the like or for processing of the printing medium.

Additionally, the term "nozzle", as used hereafter, collectively refers to an ejection opening, a liquid passage in communication therewith, and an element for generating energy for use in ink ejection, unless otherwise specified.

The above and other objects, effects, features and advantages of the present invention will become more apparent from the following description of embodiments thereof taken in conjunction with the accompanying drawings.

BRIEF DESCRIPTION OF THE DRAWINGS

FIG. 3A being a schematic diagram of the head unit as seen from a side of ejecting openings and FIG. 3B being a schematic sectional view of an ejecting portion;

FIG. 6A being a schematic diagram showing an initial condition and FIG. 6B being a schematic diagram showing bi-directional printing in a condition where the ejecting speed is lowered;

DETAILED DESCRIPTION OF THE PREFERRED EMBODIMENTS

The present invention will be described below in detail with reference to the accompanying drawings.

[Example of construction of printing apparatus]

Figure 1:
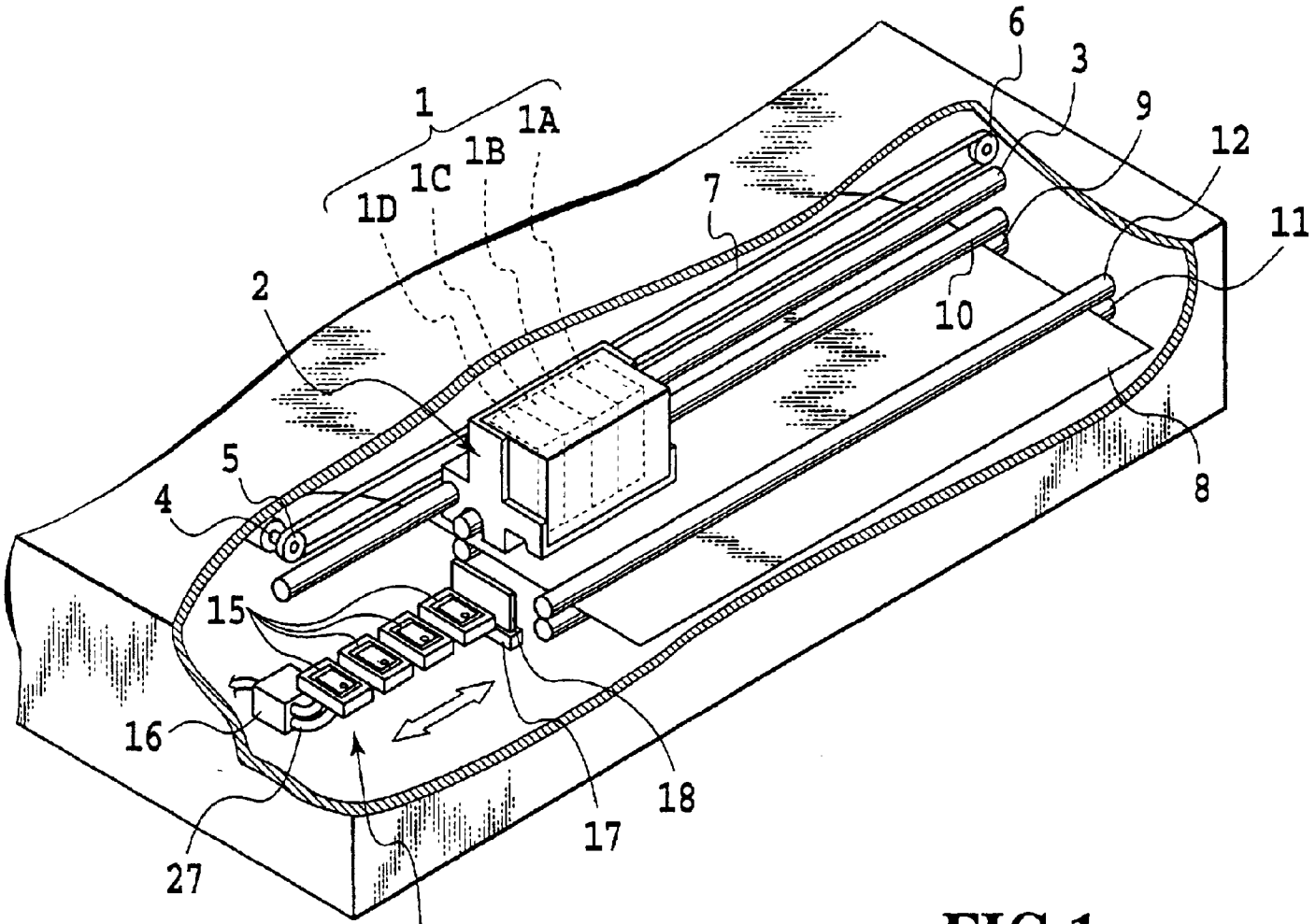
FIG. 1 is a schematic perspective view showing constructions of main members in an embodiment of an ink jet printing apparatus to which the present invention is applicable.

FIG. 1 is a schematic perspective view showing a construction of an embodiment of an ink jet printing apparatus to which the present invention is applicable.

In FIG. 1, a head unit 1 which has a plurality of (four) printing heads 1A, 1B, 1C and 1D is mounted on a carriage 2. Each of the printing heads 1A through 1D has an ejecting portion and an ink tank, and can be equipped with a connector for transmitting and receiving signals or the like which are used to drive the ejecting portion.

The plurality of printing heads are used for printing in colors different from one another and ink of different colors, for example, black (Bk), cyan (C), magenta (M) and yellow (Y) are accommodated in the ink tanks. The printing head or the head unit 1 has been positioned and exchangeably mounted on the carriage 2. A connector holder (electric connector) is attached to the carriage 2 to transmit drive signals or the like to the printing head via the connector.

The carriage 2 is guided and supported so as to be bi-directionally movable along a guide shaft 3 which extends in a main scanning direction and disposed in a body of the apparatus. The carriage 2 is driven to control its location and movement by a main scanning motor 4 via a motion transmitting mechanism consisting of a motor pulley 5, a follower pulley 6, a timing belt 7 and the like. A printing medium 8 such as printing paper, a thin plastic sheet or the like is transported (paper feeding) by rotating two pairs of transporting rollers 9, 10 and 11, 12 while passing through a location (printing portion) opposed to an ejecting face of the ejecting portion. The printing medium 8 is supported on its rear surface with a platen (not shown) so that the printing medium forms a flat printing surface at the printing portion. In this case, each of the ejecting portions mounted on the carriage 2 is held so that the ejecting face protrudes downward from the carriage 2 and is in parallel with the printing medium 8 between the above described two pairs of carrying rollers.

Each ejecting portion has ejecting heaters such as electrothermal transducers, for example, for generating thermal energy when electrically energized. The ejecting portion causes film boiling in ink on the electrothermal transducer with the thermal energy and carries out printing by ejecting the ink from an ejection opening utilizing a pressure of bubble produced by the boiling.

The head unit 1 may use printing heads for different colors which are independently arranged in place of the above-described printing heads for different colors which are integrated with each other. Furthermore, a printing head may have a construction wherein a group of nozzles for ejecting Bk ink and a group of nozzles ejecting Y, M and C inks are disposed in parallel with one another. Furthermore, the number of printing heads can be adequately selected not only dependent on kinds of colors usable in the printing apparatus but also dependent on concentrations.

Furthermore, the printing heads may have a construction integrated with the ink tanks serving as an ink supply source or be configured to receive ink from ink tanks disposed at separate locations by way of tubes or the like. When the printing heads are to be integrated with the ink tanks, these members may be configured as a cartridge which can be attached and detached to and from an apparatus main unit (cartridge) or may be separable from each other so that only the ink tanks, for example, are exchangeable independently.

Figure 2:
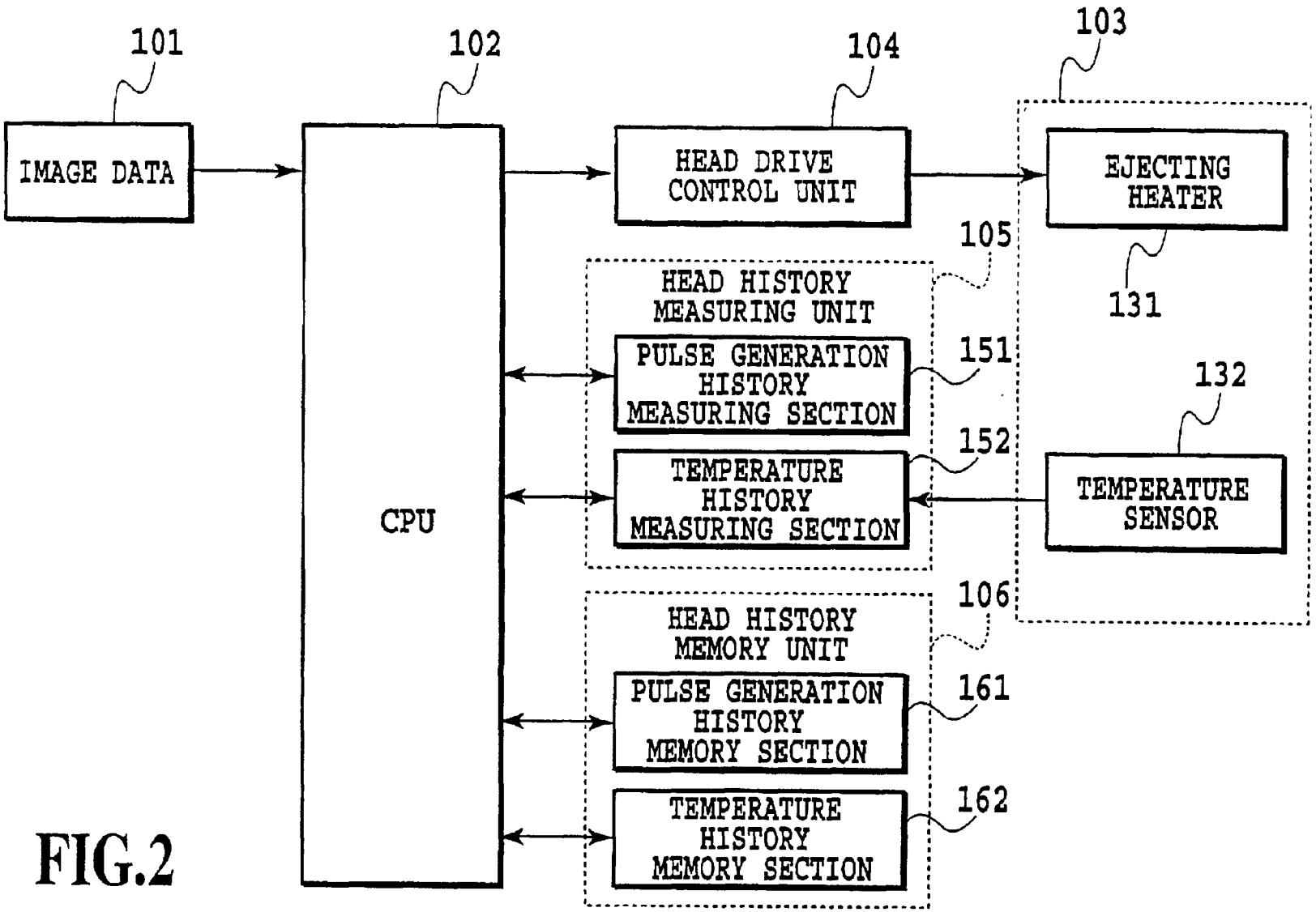
FIG. 2 is a block diagram showing an example of construction of a control system of the printing apparatus shown in FIG. 1.

FIG. 2 shows an example of construction of main members of a control system of the printing apparatus shown in FIG. 1. When image data 101 is input into a CPU 102 of the printing apparatus from a host unit (an image data supply source which may be a computer as a data processor unit, an image reading unit or the like), for example, a signal is output from the CPU 102 to head drive control unit 104. The head drive control unit 104 controls a width and a generating timing of a drive pulse to be applied to an electrothermal transducer (ejecting heater) 131 of an ejecting portion 103.

A head history measuring unit 105 counts the number of ejecting pulses with a pulse generation history measuring section 151 and measures data detected by a temperature sensor 132 disposed in the ejecting portion 103 and an elapsed time in conjunction with each other with a temperature history measuring section 152. These data measured by the head history measuring unit 105 are stored into a pulse generation history memory section 161 and a temperature history memory section 162 of a head history memory unit 106. Dependently on the data stored by the head history memory unit 106, the head drive control unit 104 modifies settings of the width and the generating timing of the drive pulse to be applied to the ejecting heater 131.

The pulse generation history measuring section 151 of the head history measuring unit 105 may have a counter which increments a count value whenever an ejecting heater drive signal is produced. The number of drive signals, which is substantially equal to the number of ink ejections, from the start of the initial use of the print head can be stored accumulatively by updating contents stored in the pulse generation history memory section 161 of the head history memory unit 106 on the basis of a value counted by the counter. Furthermore, the temperature history measuring section 152 of the head history measuring unit 105 may have an A/D converter which converts an analog signal output from the temperature sensor 132 disposed on a side of the head into a digital signal and a calculating section which performs a calculation described later so that contents stored in the temperature history memory section 162 of the head history memory unit 106 can be updated on the basis of a calculation result. A non-volatile memory such as an EEPROM or a RAM which is backed up by a battery can be used in the head history memory unit 106 so that stored contents can be retained even when electrical power to the printing apparatus is turned off.

Furthermore, the temperature sensor 132 may be formed on a substrate of the ejecting portion 103 in a process of forming the ejecting heater 131 or configured as a thermistor to be attached to the printing head. The temperature sensor 132 need not necessarily be a hardware temperature sensor so long as the temperature sensor allows to estimate a temperature from a driven condition of the ejecting portion, that is, an energy level, a driving period or a driving frequency of the drive pulse. Furthermore, the temperature sensor 132 may use a combination of the items mentioned above.

Figure 3A:
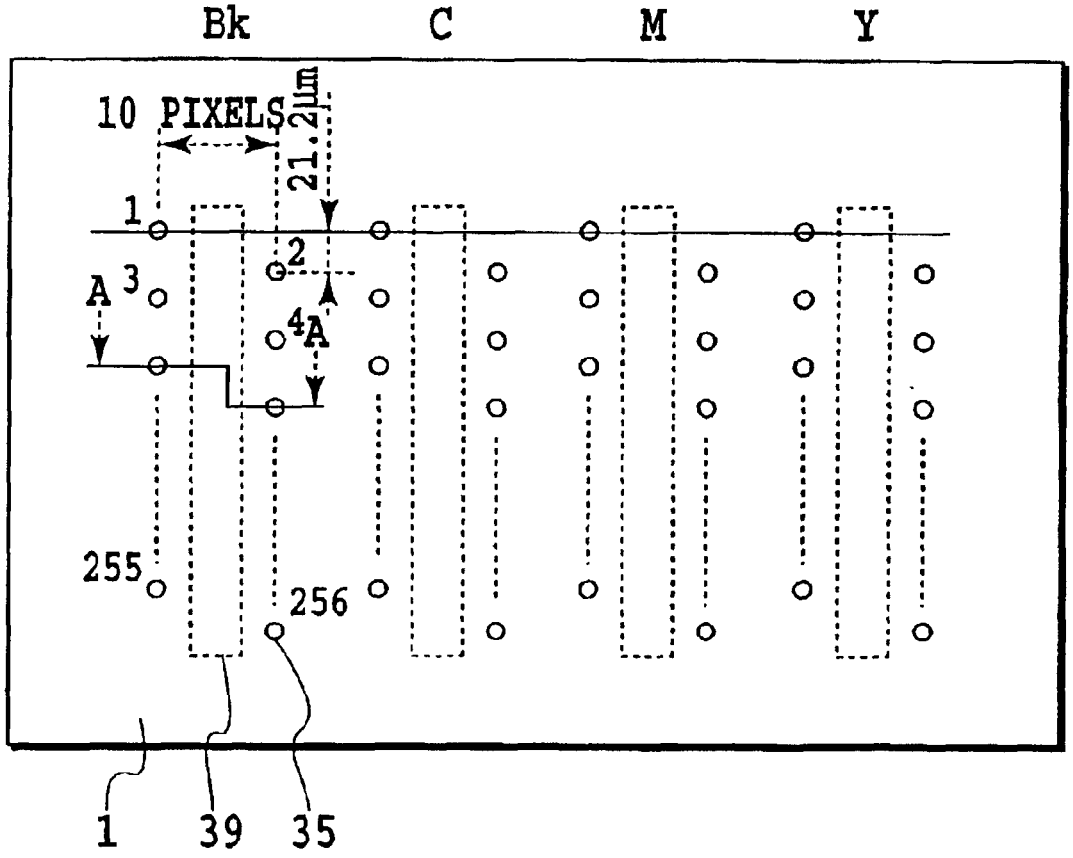
FIGS. 3A and 3B are diagrams descriptive of an example of construction of a head unit to be used in the construction shown in FIG. 1.

Configurations of the ejecting portion 103 and the head unit 1 will be described with reference to FIGS. 3A and 3B. FIG. 3A is a schematic diagram showing an example of construction of the head unit 1 as seen from a side of ejection openings which eject ink, for example, as droplets. As shown in FIG. 3A, ejection openings 35 are arranged in two columns in each ejecting portion for a color of black (Bk), cyan (C), magenta (M) or yellow (Y). The ejection openings 35 which compose these columns are distributed at locations shifted in a vertical direction in FIG. 3A, a sub-scanning direction (paper feeding direction), so as to form the so-called zigzag pattern.

In the construction shown in FIG. 3A, a nozzle arrangement density is 1200 DPI and nozzles are disposed at a pitch of approximately 21.2 $\mu$m in the sub-scanning direction. Furthermore, it is desirable that a spacing between the two columns for each color is a multiple of the pitch of the nozzle, specifically, a multiple on the order of 10 times of the pitch of the nozzle (approximately 212 $\mu$m) since an ink supply port 39 is disposed between the columns of the ejection openings as shown in FIG. 3B.

Figure 3B:
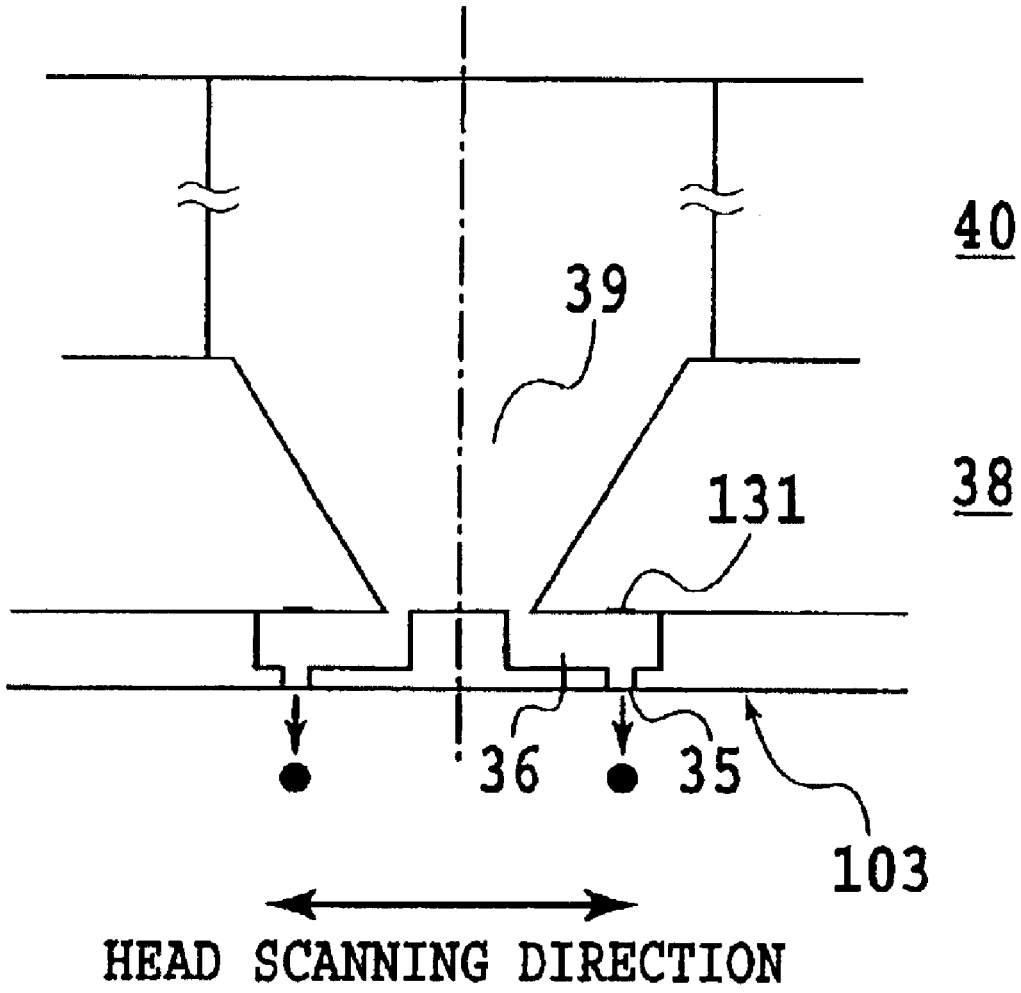

The ejecting portion has a construction wherein the ejecting heater 131 is disposed on a substrate 38 in which the supply port 39 is formed as shown in FIG. 3B. A liquid path 36 and the ejection opening 35 are formed by a process such as photolithography of a positive type resist layer which is a templating member for the nozzle and a layer of a photosensitive resin such as an epoxy resin having resistance to ink. Furthermore, the substrate 38 is supported by a base plate 40.

When a vertical line of Bk is to be formed on a printing medium with the ejecting portion having the above described construction, that is, when ink is to be ejected from a group of the ejection openings in the two columns and landed on the same location in the main scanning direction of the head, for example, the vertical line can be formed by delaying a timing of ejection from the nozzles in a second column as compared with a timing of ejection from the nozzles in a first column by a predetermined amount (corresponding to 10 pixels in this embodiment).

[Correction dependent on head history]

Figure 4:
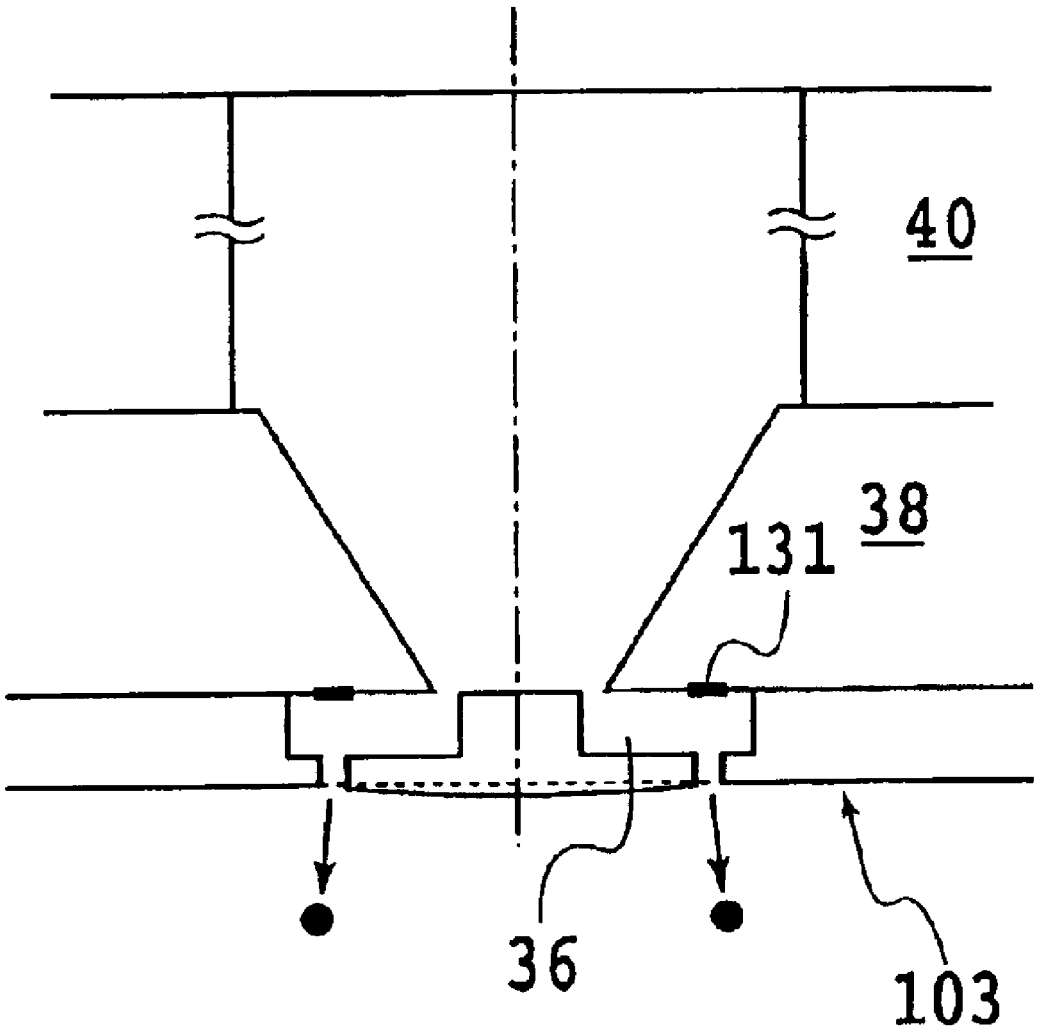
FIG. 4 is a schematic sectional view descriptive of an ejecting condition from the ejecting portion which is used for a long time.

FIG. 4 is a schematic sectional view of a condition of the ejecting portion which has been used for a long time. Since the ejecting portion which has the above-described construction has the nozzles made of the photosensitive resin such as the epoxy resin, the ejecting portion absorbs water or a liquid and is deformed slightly at a region surrounding the ejection opening. When the ejecting portion is deformed as described above, ink is ejected in a direction which is deviated at a slight angle from a direction perpendicular to a printing surface of a printing medium.

As a result of experiments and eager examinations, the inventor has found that the deviation of an ejecting angle, that is, a deviation of the dots between the two nozzle columns in the ejecting portion for each color, can be previously estimated from a head temperature and a time of use at the temperature.

Figure 5:
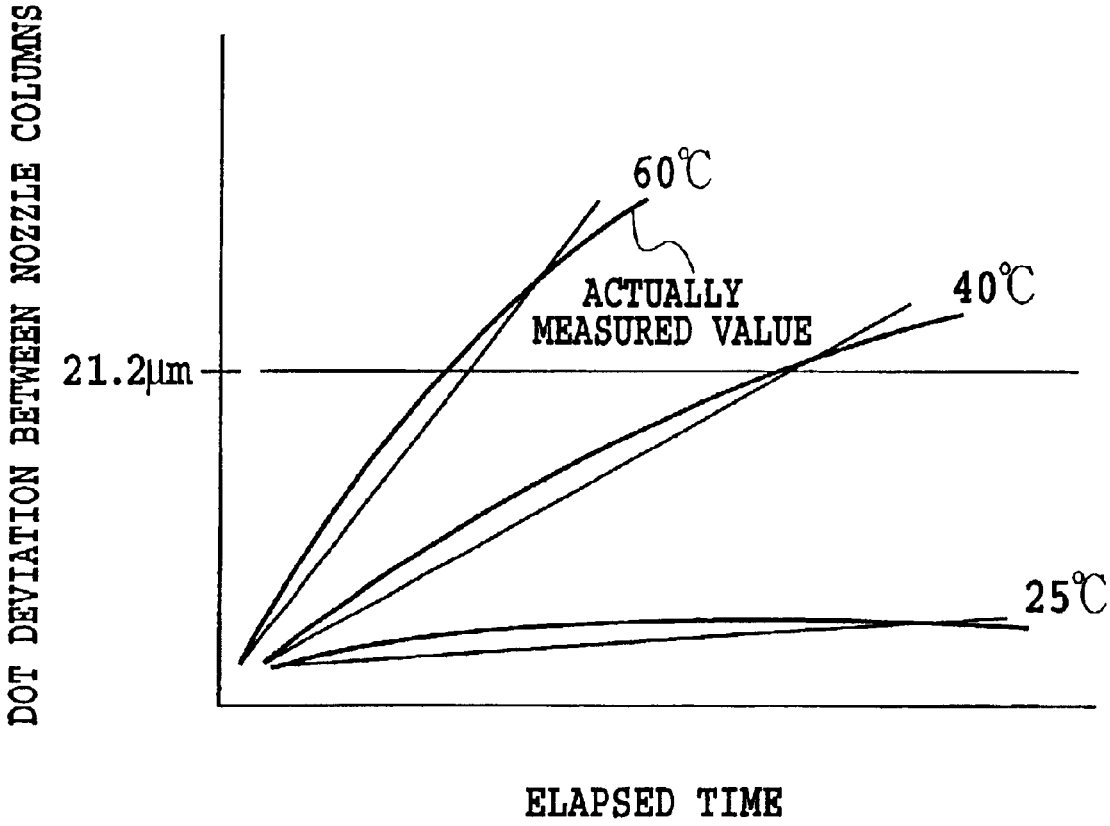
FIG. 5 is a diagram descriptive of relationship between a dot deviation between nozzle columns in the ejecting portion and an elapsed time of use at different temperatures.

FIG. 5 is a diagram descriptive of the relation between the deviation of the dots between the nozzle columns and an elapsed time of use at different temperatures based on the measured values obtained through experiments. It is possible to prevent the deviation of dots between the nozzle columns by a change of the ejecting angle, by adjusting the timing of ejection from the second nozzle column relative to the timing of ejection from the first nozzle column, that is, by correcting an ejection delay time of the second nozzle column relative to the ejection time of the first nozzle column, utilizing the relationship shown in FIG. 5.

However, it has been experimentally confirmed that the deviation of the dots between the nozzle columns within a pixel (21.2 $\mu$m in this embodiment) scarcely influences on image formation and it is sufficient to adjust the ejection timing (correct the ejection delay time) once or twice before a service life of the head itself expires. In order to simplify a calculation processing, a total sum of (head temperature T)×(elapsed time t)×(temperature coefficient AT) at each temperatures is to be stored as a temperature history data in the memory section 162 and the ejection delay time is to be corrected by the drive control means 104 when the temperature history data exceeds a predetermined threshold value.

Now, description will be made of changes of ejection characteristics which are caused dependently on the number of ejecting pulses.

In case of an ejecting portion which uses an ejecting heater which generates a thermal energy as an energy to be utilized for ejecting ink as in the embodiment, ejecting characteristics are changed (an ink ejecting rate and an ejecting speed are lowered in particular) due to "scorch" caused in the ejecting heater. It is therefore possible to estimate a "scorch" condition or lowered conditions of the ink ejecting rate and the ink ejecting speed when the number of ejecting pulses from the start of the initial use is counted by the pulse generation history measuring section 151 and stored into the pulse generation history memory section 161. The ejecting characteristics can be stably maintained by adequately setting an energy (a pulse width in this embodiment) of an electric signal to be applied to the ejecting heater by the drive control means 104 when the stored number of the ejecting pulses exceeds a predetermined value.

When printing is carried out by bi-directional main scanning in particular, lowering of the ejection speed constitutes a cause for a deviation of dot forming locations (the so-called rule mark deviation in a case where vertical rule marks are printed by bi-directional printing).

Figure 6A:
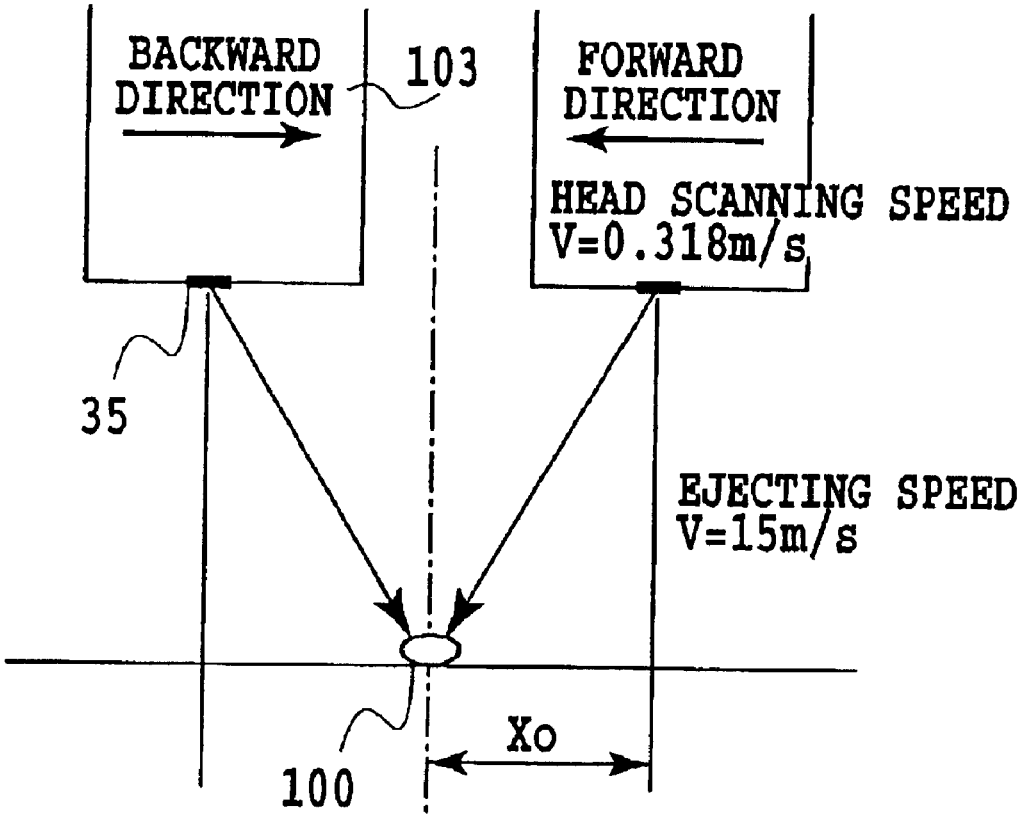
FIGS. 6A and 6B are diagrams descriptive of a manner in which an ink ejecting speed lowered due to a use history of a printing head causes a deviation of a dot forming location for bi-directional printing operations.
Figure 6B:
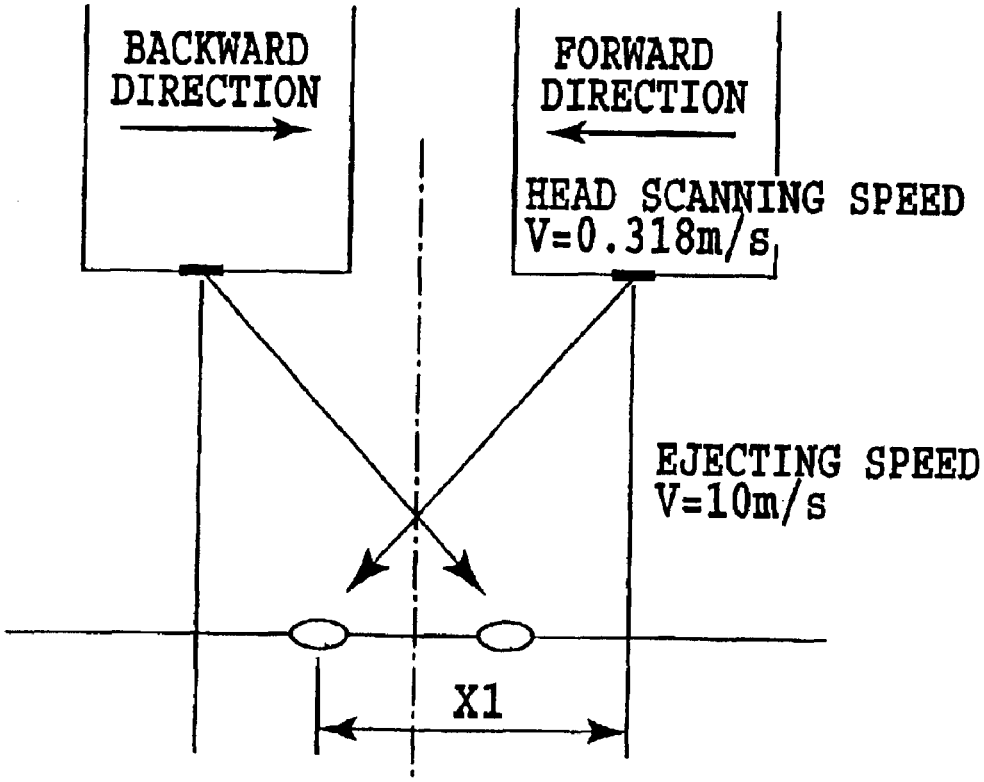

FIGS. 6A and 6B are schematic diagrams descriptive of the rule mark deviation. FIG. 6A shows an initial condition where an ink drop 100 is ejected at an ejecting speed (v) of 15 m/s from the ejection opening 35 of the ejecting portion 103, a spacing between the ejection opening 35 and a printing medium is 1 mm and a main scanning speed of the head is 0.318 m/s for a recording density of 1200 DPI at a drive frequency of 15 kHz. A reference symbol X0 in FIG. 6A represents a moving distance of the ink drop in the main scanning direction until the ink drop reaches the printing medium after application of the ejecting pulse and X0=21.2 $\mu$m in the initial condition. When the bi-directional printing is to be carried out with the ink jet head, a delay time for the bi-directional printing is determined taking a time corresponding to X0 into consideration.

In case of FIG. 6B showing the bi-directional printing in a condition where the ejection speed (v) is lowered to 10 m/s due to a head history, a moving distance of the ink drop in the main scanning direction until the ink drop reaches the printing medium after the application of the ejecting pulse is X1=31.8 $\mu$m.

As a result, a location of a dot formed by main scanning in a forward direction is deviated from a location of a dot formed by main scanning in a backward direction for a distance of 2×(31.8−21.2)=21.2 $\mu$m.

Accordingly, it is possible to prevent such a deviation from being caused and form a stable image by adequately correcting a delay time for the bi-directional printing according to the pulse generation history.

[Mounting example of history memory unit]

In the above described printing apparatus, the head history memory unit may be disposed on a side of the printing apparatus body so that contents of the head history memory unit are refreshed when the head unit 1 is exchanged. Alternatively, the head unit may have a construction described below.

Figure 7:
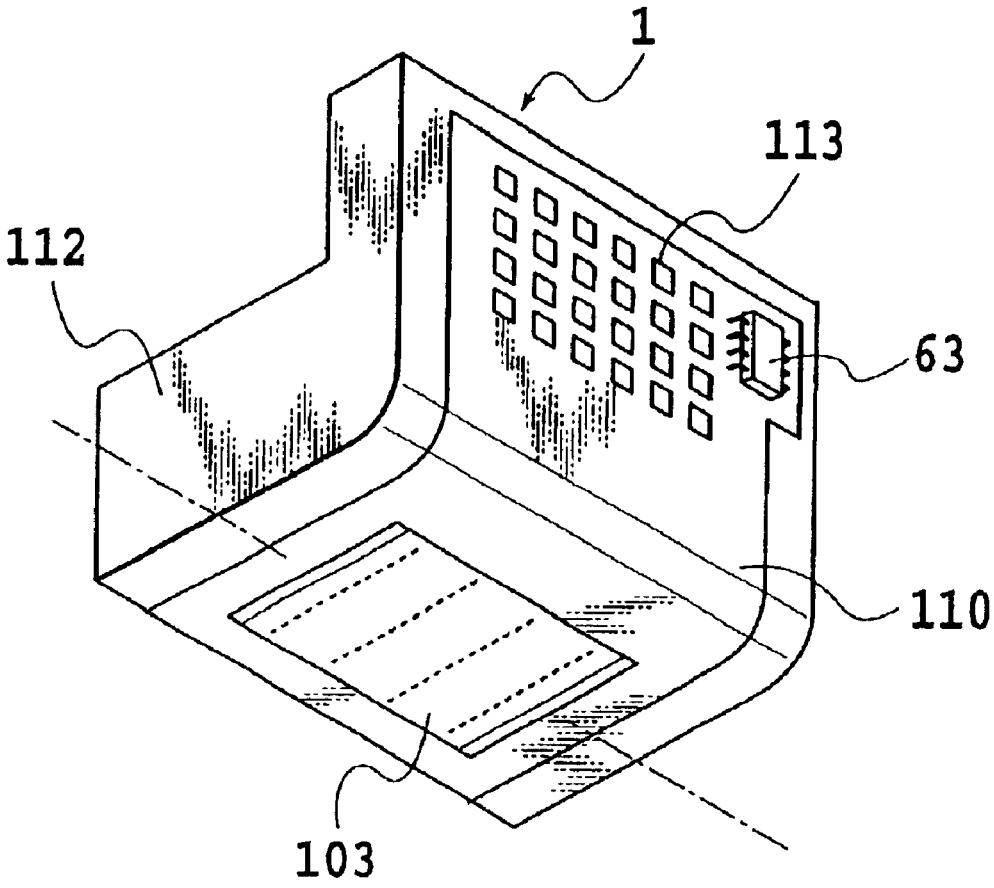
FIG. 7 is a perspective view showing another example of construction of the head unit to which the present invention is applicable.

FIG. 7 shows another example of construction of the head unit 1 comprising an ejecting portion 103 in which an ejecting heater, an ejection opening and the like are formed, a flexible cable 110 electrically connected to the ejecting heater, and a chip tank 112 in which an ink supply path from an ink tank portion (not shown) to the ejecting portion 103 is formed. Furthermore, disposed at a terminal end of the flexible cable 110 is a contact pad portion 113 which is brought into contact with a connecting portion disposed on a carriage for electrical connection to the printing apparatus body. An EEPROM 63 is mounted in the vicinity of the contact pad portion 113 as the head history memory unit 106. Though FIG. 7 shows a condition where the EEPROM 63 and the contact pad portion 113 are disposed on an identical side surface, the EEPROM 63 may be disposed on a rear surface to make it unnecessary to prepare a recess for mounting the head unit 1 on the main unit of the printing apparatus or the carriage.

When the EEPROM 63 adopted as the head history memory unit 106 is disposed on a side of the head unit 1 as described above, it is possible to obtain an adequate drive condition by providing data peculiar to the ejecting portion 103 or the head unit 1, that is, a construction and an initial drive control timing of the ejecting portion of the head unit, to the printing apparatus thereby making an adjustment by the printing apparatus. Furthermore, since stored contents are maintained even after the head unit 1 which is usable continuously is temporally exchanged with another unit dependently on an image to be formed or an operator's desire and mounted once again, the printing apparatus can perform a printing operation appropriately.

[Example of control corresponding to head history]

Figure 8:
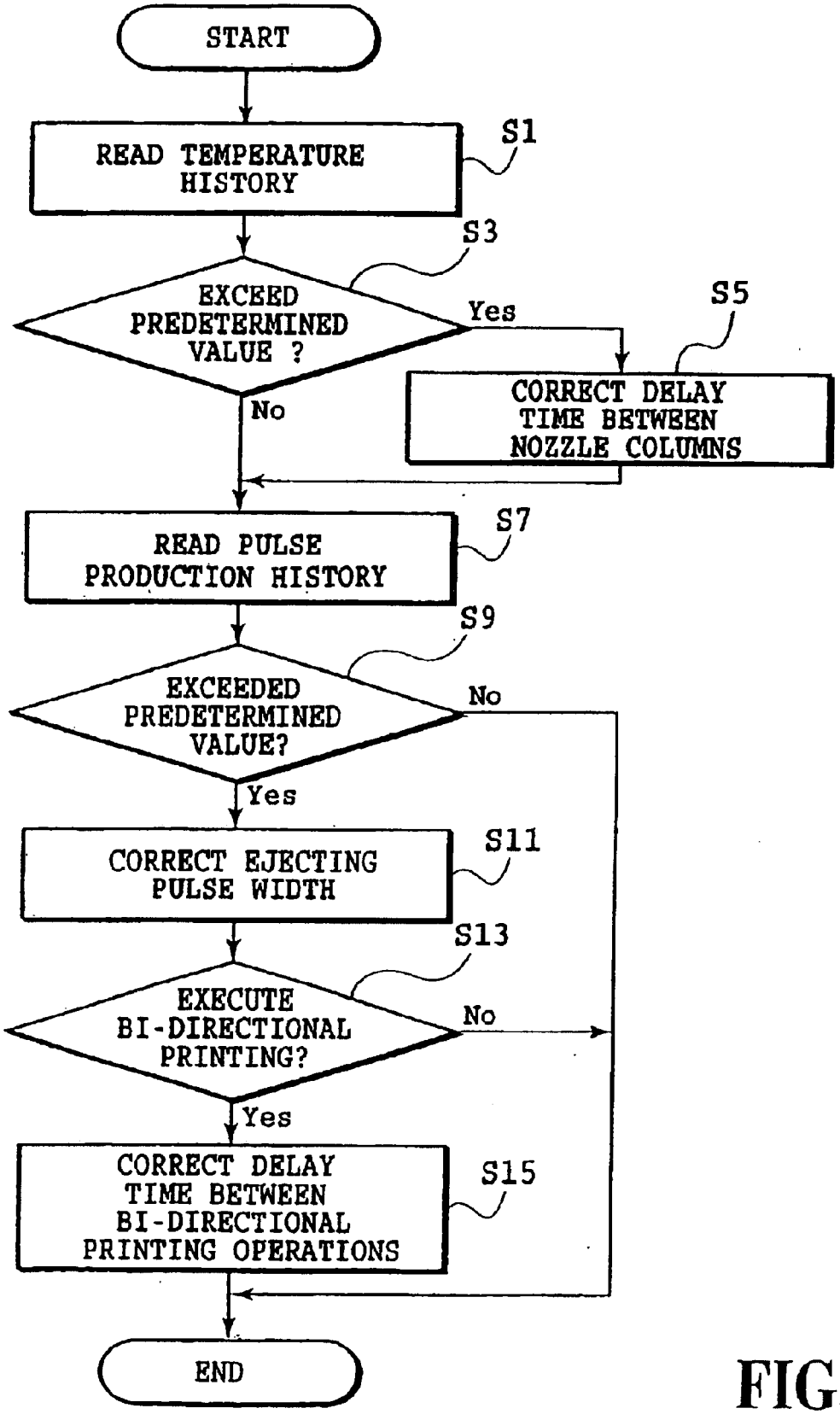
FIG. 8 is a flow chart showing an example of control procedures for correcting a head driving timing according to the history of the head.

FIG. 8 is a flow chart exemplifying a control procedure for correcting a head drive timing corresponding to a head history. This procedure can be started upon electrically energizing the printing apparatus, at an interval of a predetermined time or a predetermined printing amount, after exchange of the head unit or at another adequate timing.

When the procedure is started, data related to a temperature history is read out which is stored in the temperature history memory unit 162 or the EEPROM 63 in step S1. Next, in step S3, it is judged whether or not the read temperature history data exceeds a predetermined value, and when an affirmative judgement is made, a correction of an ejection delay time already set for a second nozzle column relative to a first nozzle column is carried out (step S5).

In step S7, data related to a pulse generation history (the number of ejecting pulses transmitted from the start of the initial use, that is, the number of the ejections) stored in the pulse generation history memory section 161 or the EEPROM 63 is read out. In step S9, it is judged whether or not the read number of pulses exceeds a predetermined value and when a negative judgement is made, the control procedure is terminated. In step S9, when an affirmative judgement is made, an energy (pulse width in this example) of the electric signal to be applied to the ejecting heater is reset at an adequate value to obtain a stable ejecting amount (step S11).

In step S13, it is judged whether or not the bi-directional printing is executed and when an affirmative judgement is made, an ejection timing of bi-directional printing operation is adequately corrected dependently on the pulse generation history, thereby preventing a deviation from being caused in the bi-directional printing operation (step S15).

Though the delay time of the first nozzle column relative to the second nozzle column is corrected according to the temperature history at the step S5 for the head unit 1 which has an ejection portion with the nozzles in the two columns for each color in the example described above, an adequate item may be selectable according to a construction of the head unit. When ahead unit has nozzles in three or more columns, for example, a relation among these columns of nozzles may be corrected according to a temperature history. Dependently on a construction of the printing head, material of the ejecting portion and the like, it is possible to correct a relation among nozzles which are arranged in one, two or more columns in each ejecting portion for a plurality of tones (colors or concentrations) according to the temperature history. When the head unit is constructed to be capable of detecting temperature of each nozzle or each group of a predetermined number of nozzles, it is possible to store and correct a temperature history using the nozzle or the nozzle group as a unit.

In the embodiments described above, the correction of the energy (pulse width) of the electric signal to be applied to the ejecting heater (step S11) and the correction of the ejection timing in the bi-directional printing operation (step S15) are performed according to the pulse generation history. The printing apparatus may be configured to perform the corrections corresponding to the pulse generation history not only of a relation in a same ejecting portion but also a relation among a plurality of ejecting portions taking into consideration color recording which is carried out by overlapping a plural kinds of ink at the same location. In this case also, a pulse generation history maybe stored and corrected using each nozzle or each group of a predetermined number of nozzles as a unit.

Though the ejection timing between the nozzle columns, the ejection timing in the bi-directional printing operation and the energy (pulse width) of the drive signal are controlled according to the pulse generation history and the temperature history in the embodiments described above, any of these items may be selectable according to a construction of the printing head or as occasion demands.

Figure 9:
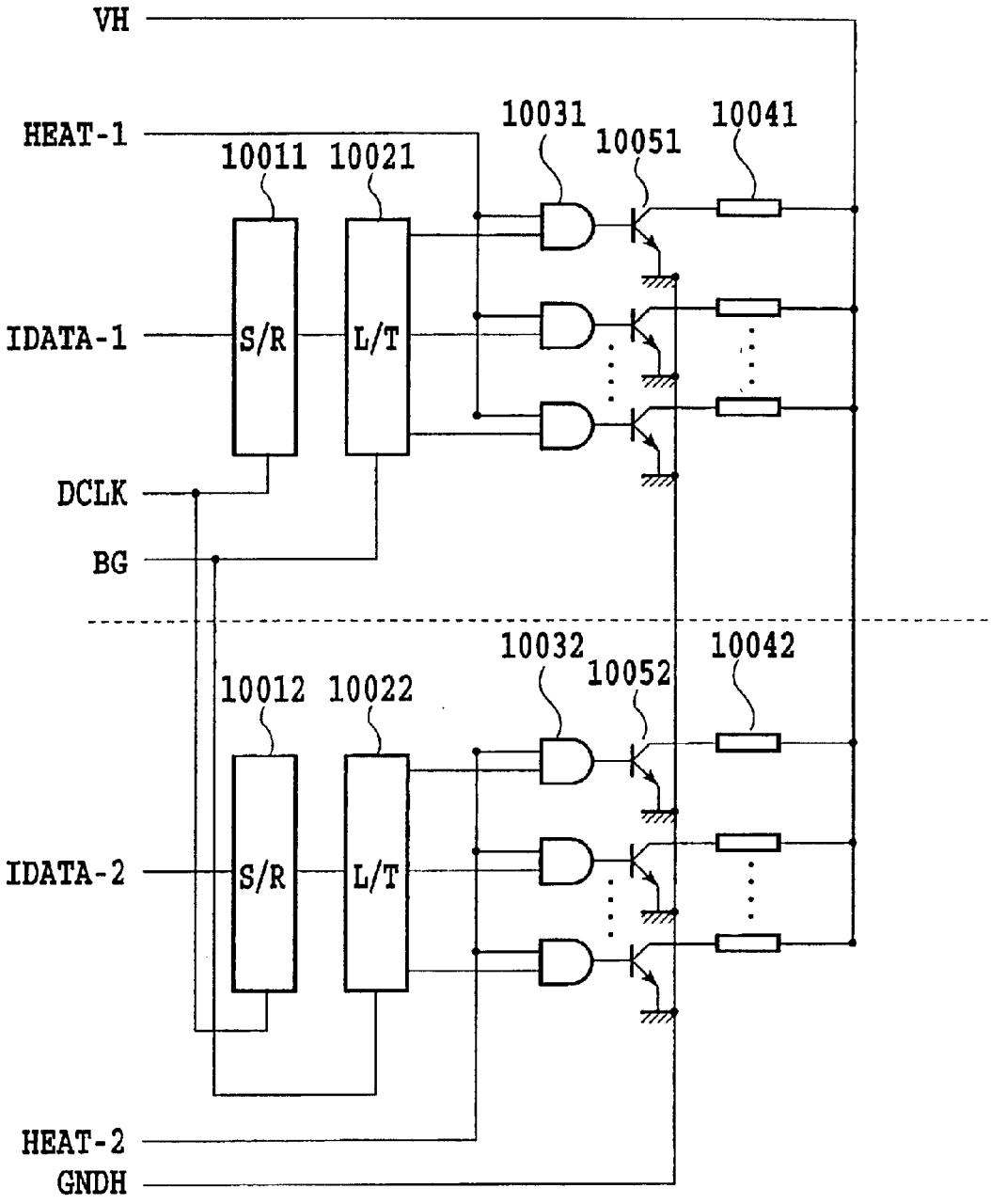
FIG. 9 is a diagram showing an example of a driving circuit of a print head for implementing control procedures of FIG. 8.

FIG. 9 illustrates a driving circuit of a print head for implementing control of FIG. 8. The driving circuit is roughly divided into a transistor array portion for turning on/off a current, and a control portion for controlling the on/off timing of the transistor array portion and data. Further, the transistor array portion is composed of transistors 10051 and 10052 for supplying large current to the ejecting heaters 10041 of a first nozzle column and ejecting heaters 10042 of a second nozzle column. The control portion is composed of AND circuits 10031 and 10032, print buffers 10021 and 10022, and shift registers 10011 and 10012 so as to correspond to the respective nozzle columns.

Signal lines for transmitting signals IDATA-1, IDATA-2 and a signal line for transmitting a clock signal DCLK are connected to the control portion in order to receive print data. The print data is forwarded as the signal IDATA-1 and IDATA-2 to be stored in the shift registers at the rise of DCLK. The print data is sequentially forwarded to a storing device in synchronism with the rise of the IDATA-1 or IDATA-2 signals which are sequentially transferred.

Print data is arranged in the shift registers 10011 and 10012 by supplying the DCLK signals corresponding to the number of nozzles (256 nozzles in this embodiment) in each nozzle column, as well as the print data in synchronism with the rise of the DCLK signals. The print data in the shift registers 10011 and 10012 is forwarded to the print buffers 10021 and 10022 so that the shift registers 10011 and 10012 may be in a condition which permits to receive next print data. Data transfer from the shift registers 10011 and 10012 to the print buffers 10021 and 10022 is carried out by activation from the BG signal. The print data of the shift registers 10011 and 10012 are forwarded to the print buffers 10021 and 10022 at the timing of the rise of the BG signal.

With respect to the print data transferred to the print buffer, a logical multiplication is obtained by the AND circuit 10031 or 10032 with the HEAT-1 or HEAT-2 signal for effecting time control for passing electric current through the ejecting heater 10041 or 10042. The output signals of the AND circuits 10031 and 10032 are coupled to the transistors 10051 and 10052, respectively. The ejecting heaters 10041 and 10042 generate heat in accordance with ON/OFF of the transistors 10051 and 10052, respectively.

Figure 10A:
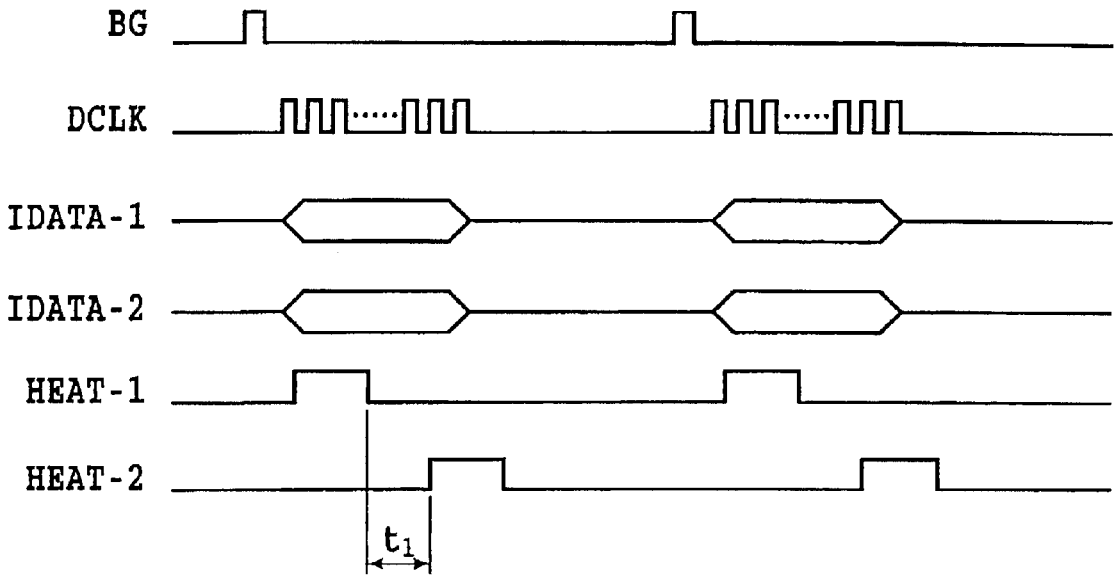
FIGS. 10A and 10B are timing charts for illustrating the signals of the driving circuit of FIG. 9.
Figure 10B:
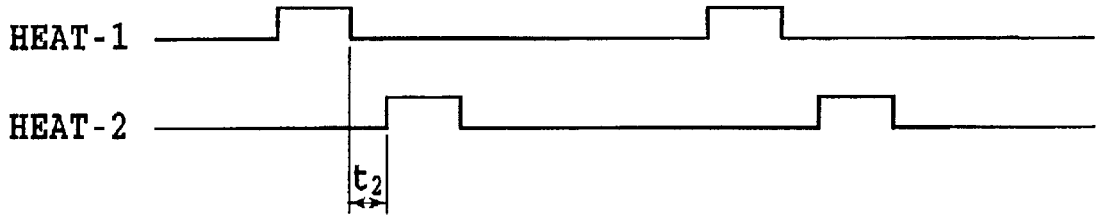

FIG. 10A and FIG. 10B each illustrate a timing chart of the signals of the driving circuit of FIG. 9. In FIG. 10A, a delay time t1 of the ejection timing of the second nozzle column relative to the ejection timing of the first nozzle column is determined by computation effected by the CPU 102 of the main body shown in FIG. 2. Based on this, the HEAT-1 and HEAT-2 signals are transmitted to the print head. FIG. 10B shows a state in which the delay time has been changed from the state of t1 in FIG. 10A to the state of t2 in accordance with the above-mentioned temperature history.

[Others]

The present invention, in ink jet printing methods, achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structural and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to generate thermal energy corresponding to recording information; second, the thermal energy induces a sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As understood from the foregoing description, the present invention makes it possible to prevent ejecting characteristics and dot forming locations on a printing medium from being varied due to a use history of a printing head. Accordingly, the present invention makes it possible to prolong a service life of a printing head without allowing the printing head to produce stripes or color ununiformity perceived by the human eye in forming fine images such as images having photographic tones, thereby allowing a service life in forming images to be prolonged and the printing head to stably form images of high qualities until the service life of the printing head itself expires.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet printing apparatus which carries out printing using a printing head for ejecting ink, comprising:

means for measuring data related to use histories of a number of drives and a temperature change of the printing head; and means for changing a timing of ink ejection from the printing head on the basis of the data related to the use histories of the number of drives and the temperature change.

2. An ink jet printing apparatus as claimed in claim 1, wherein said printing head has ejection openings arranged in a plurality of columns in a direction different from a scanning direction relative to a printing medium, and said changing means changes an ink ejection timing between the plurality of columns.

3. An ink jet printing apparatus as claimed in claim 1, further comprising means for printing by bi-directionally scanning the printing head relative to a printing medium, and wherein said changing means changes an ink ejection timing in a forward direction relative to an ink ejection timing in a backward direction.

4. An ink jet printing apparatus as claimed in claim 1, further comprising control means for controlling an amount of ink to be ejected by adjusting an energy of a drive signal to be applied to the printing head for ejecting the ink.

5. An ink jet printing apparatus as claimed in claim 4, wherein said control means adjusts a width of a pulse of the drive signal to be applied to the printing head.

6. An ink jet printing apparatus as claimed in claim 1, wherein said measuring means comprises means for counting a number of drive signals applied to the printing head for ejecting the ink.

7. An ink jet printing apparatus as claimed in claim 6, further comprising memory means for accumulatively storing the number of the drive signals from the start of initial use of the printing head as data related to the use histories of the number of drives and the temperature change on the basis of measurements by said measuring means.

8. An ink jet printing apparatus as claimed in claim 1, wherein said measuring means comprises means for measuring a temperature of the printing head and a time elapsed at the temperature in conjunction with each other.

9. An ink jet printing apparatus as claimed in claim 1, wherein:

said measuring means comprises means for counting a number of drive signals applied to the printing head for ejecting the ink, and means for measuring a temperature of the printing head and a time elapsed at the temperature in conjunction with each other; and said changing means, according to the data related to the use histories of the number of drives and the temperature change on the basis of measurement by said measuring means, changes the timing of the ink ejection from the printing head and controls an amount of the ink to be ejected by adjusting an energy of a drive signal to be applied to the printing head for ejecting the ink.

10. A printing head used for an ink jet printing apparatus having means for measuring data related to use histories of a number of drives and a temperature change of said printing head and means for changing a timing of ink ejection from said printing head on the basis of the data related to the use histories of the number of drives and the temperature change, said printing head being in a form of a unit detachably mounted on the ink jet printing apparatus, said printing head comprising:

means for ejecting ink; and means for storing data related to the use histories of the number of drives and the temperature change on the basis of measurement by the measuring means.

11. A printing head as claimed in claim 10, wherein said ejecting means comprises an electrothermal transducer for generating thermal energy to make the ink film-boil, as an energy used for ejecting the ink.

12. A printing method using a printing head for ejecting ink, comprising the steps of:

measuring data related to use histories of a number of drives and a temperature change of the printing head; and changing a timing of ink ejection from the printing head on the basis of the data related to the use histories of the number of drives and the temperature change.

13. A printing method as claimed in claim 12, wherein the printing head has ejection openings arranged in a plurality of columns in a direction different from a scanning direction relative to a printing medium, and said changing step changes an ink ejection timing between the plurality of columns.

14. A printing method as claimed in claim 12, further comprising a step of printing by bi-directionally scanning the printing head relative to a printing medium, and wherein said changing step changes an ink ejection timing in a forward direction relative to an ink ejection timing in a backward direction.

15. A printing method as claimed in claim 12, further comprising a control step of controlling an amount of ink to be ejected by adjusting an energy of a drive signal to be applied to the printing head for ejecting the ink.

16. A printing method as claimed in claim 15, wherein said control step adjusts a width of a pulse of the drive signal to be applied to the printing head.

17. A printing method as claimed in claim 12, wherein said measuring step comprises a step of counting a number of drive signals applied to the printing head for ejecting the ink.

* * * * *